US011622641B1

(12) United States Patent
Stacey

(10) Patent No.: US 11,622,641 B1
(45) Date of Patent: Apr. 11, 2023

(54) PORTABLE DRESSING AID DEVICE

(71) Applicant: Edwin J. Stacey, Woodland Hills, CA (US)

(72) Inventor: Edwin J. Stacey, Woodland Hills, CA (US)

( * ) Notice: Subject to any disclaimer, the term of this patent is extended or adjusted under 35 U.S.C. 154(b) by 0 days.

(21) Appl. No.: 17/539,351

(22) Filed: Dec. 1, 2021

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/905
USPC ..... 223/111
See application file for complete search history.

(56) References Cited

U.S. PATENT DOCUMENTS 2,982,453 A * 5/1961 Zicarelli ..... A47G 25/905 223/112
3,231,160 A * 1/1966 Glanville ..... A47G 25/905 223/111
4,898,309 A * 2/1990 Fischer ..... A47G 25/904 248/314
D316,176 S * 4/1991 Fischer ..... D2/641
5,630,534 A * 5/1997 Maier ..... A47G 25/905 223/111
6,932,252 B2 * 8/2005 Simmons ..... A47G 25/905 223/111
7,070,074 B2 * 7/2006 Landsberger ..... A47G 25/905 223/111
8,393,503 B2 * 3/2013 Moscato ..... A47G 25/905 223/112
8,857,679 B2 * 10/2014 Skerman ..... A47G 25/908 223/111
9,032,551 B2 * 5/2015 Hildebrandt ..... A61F 13/041 2/111
9,282,840 B2 * 3/2016 Moscato ..... A47G 25/905
10,085,579 B2 * 10/2018 Milligan ..... A47G 25/90
10,918,233 B2 * 2/2021 Shahar ..... A47G 25/90
11,213,154 B1 * 1/2022 Timothy ..... A47G 25/90

FOREIGN PATENT DOCUMENTS

WO WO-2011085439 A1 * 7/2011 ..... A47G 25/90

* cited by examiner

*Primary Examiner* — F Griffin Hall
(74) *Attorney, Agent, or Firm* — Vladi Khiterer

(57) ABSTRACT

A portable dressing aid device for disabled or elderly persons has C-shaped elongated slides with smooth inner surface in order for a user's feet to bypass the fabric of underwear or pants. Underwear or pants are placed on one end of the slides and the user's feet are inserted into the other end of the slides. Once the user's feet clear the garment, the slides are removed. The slides attach to or detach from a joining block, making the device in a disassembled condition compact and easy to carry in a small bag.

2 Claims, 4 Drawing Sheets

PORTABLE DRESSING AID DEVICE

FIELD OF THE INVENTION

The present invention pertains to the field of portable dressing aid devices, and more particularly to the field of the devices used to assist disabled and elderly persons to don underwear and pants.

BACKGROUND OF THE INVENTION

Able people take putting on clothes for granted. However, for a disabled or elderly person, putting on underwear or pants can become a difficult chore. This difficulty is caused primarily by feet getting tangled in the fabric of a garment, coupled with imperfect balance and control over one's movements while putting on underwear or pants. What is needed, therefore, is a dressing aid device that bypasses the fabric while passing one's feet through the garment. Ideally, such dressing aid device would be compact and easily carried during travel or visits to a hospital in a small bag or container.

SUMMARY OF THE INVENTION

The present invention satisfies this need. The portable dressing aid device according to this invention uses C-shaped elongated slides with smooth inner surface to bypass the fabric of the garment and then be removed once a user's feet clear the garment. The slides easily attach to or detach from a joining block, making the device in a disassembled condition compact and easy to carry in a small bag.

BRIEF DESCRIPTION OF THE DRAWING FIGURES

DETAILED DESCRIPTION OF THE PREFERRED EMBODIMENT

Figure 1:
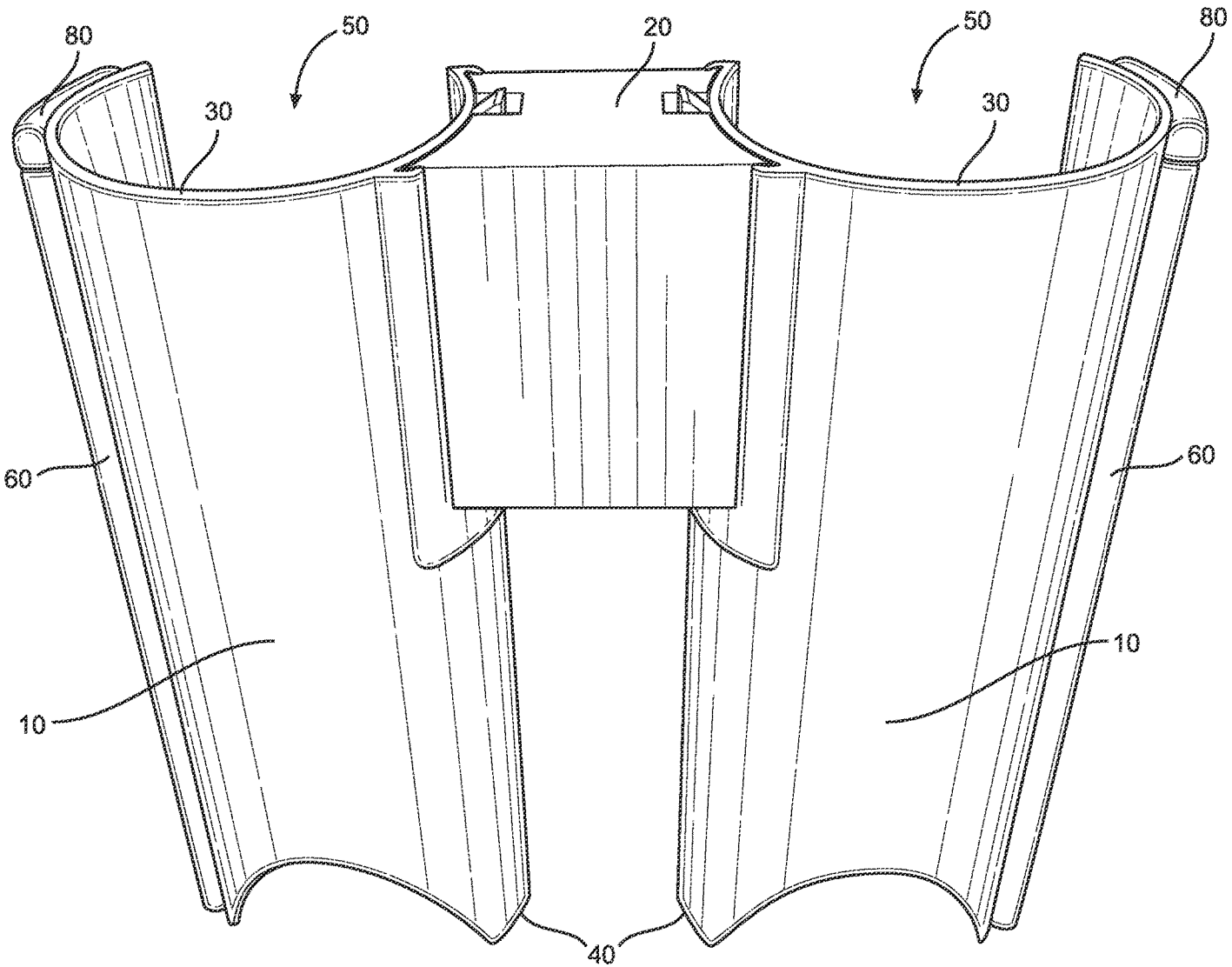
FIG. 1 shows an isometric view of a portable dressing aid device according to this invention in an assembled condition.
Figure 2:
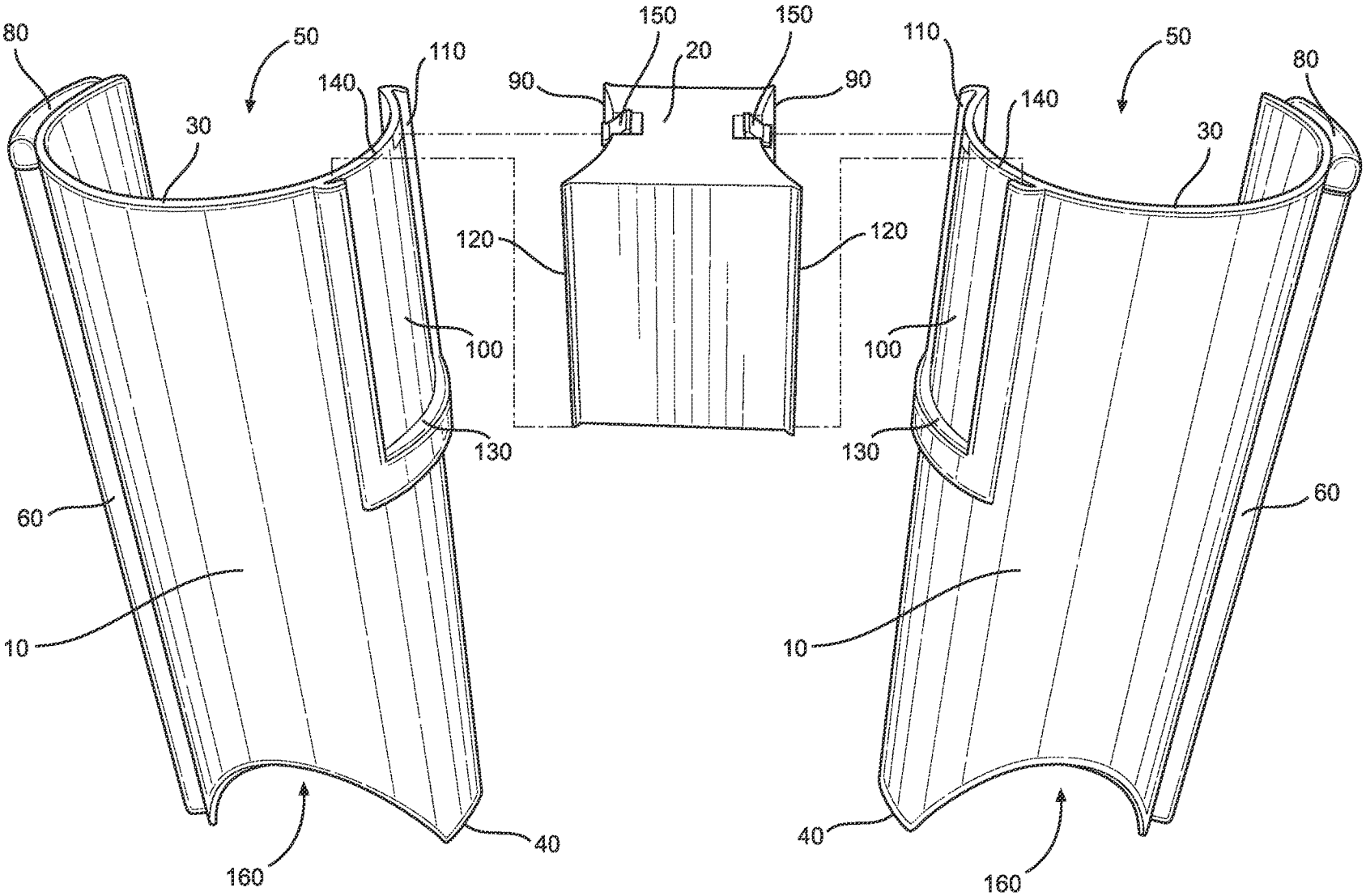
FIG. 2 shows an isometric view of a portable dressing aid device according to this invention in a disassembled condition.
Figure 3:
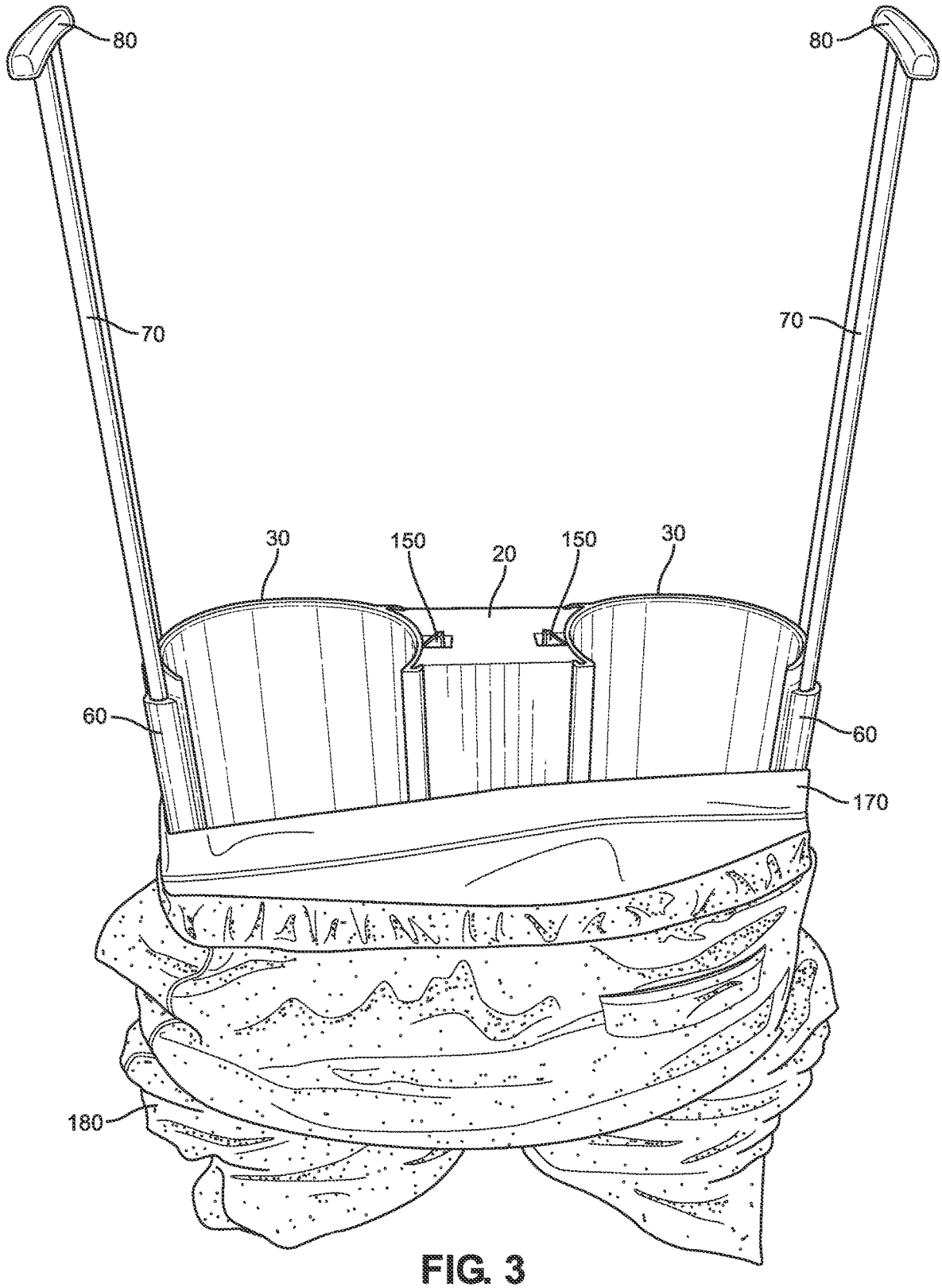
FIG. 3 shows an isometric view of a portable dressing aid device according to this invention in an assembled condition with underwear and pants positioned thereon.
Figure 4:
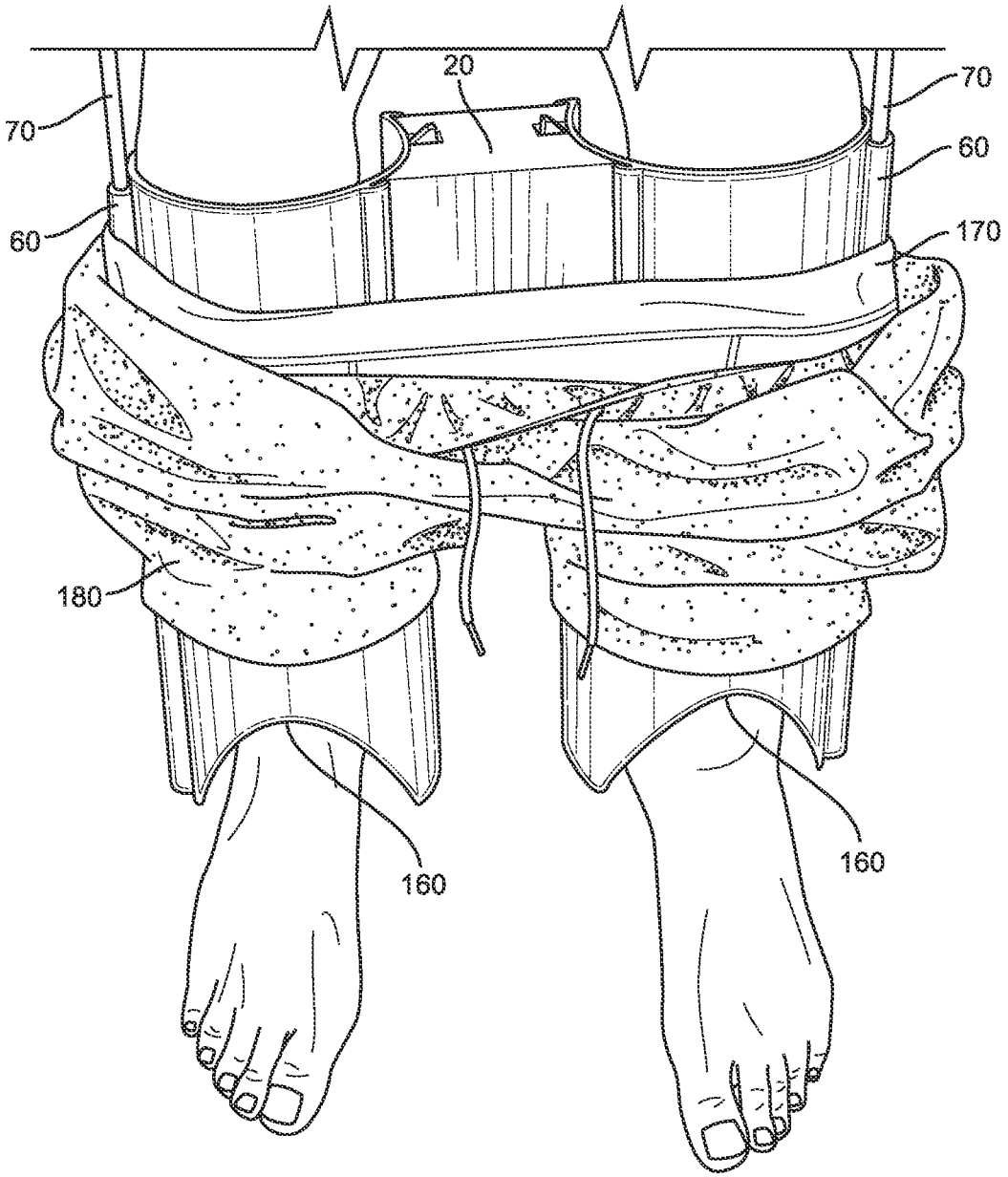
FIG. 4 shows an isometric view of a portable dressing aid device according to this invention in the process of use thereof.

This invention will be better understood with the reference to FIG. 1 through FIG. 4. The same numerals indicate the same elements in all drawing figures.

Viewing, simultaneously, FIG. 1, FIG. 2, FIG. 3 and FIG. 4, numeral 10 indicates an elongated slide. There are two elongated slides 10 and they are attached, removably and symmetrically, to a joining block indicated by numeral 20.

Slide 10 comprises an open proximal end indicated by numeral 30. Open proximal end 30 is adapted for inserting a user's foot and passing the user's foot through slide 10.

Slide 10 also comprises an open distal end indicated by numeral 40. Open distal end 40 is adapted for positioning the user's underwear, indicated by numeral 170, and pants, indicated by numeral 180, over slides 10 and inserting the user's feet therethrough. Slide 10 has a smooth inner surface to facilitate inserting the user's feet and thus bypassing the fabric of underwear 170 and pants 180. The preferred embodiment shows slides 10 fabricated from plastic by way of injection molding, which allows to achieve the requisite smoothness of the inner surface.

Slides 10 have a C-shaped cross section defining an open side indicated by numeral 50. Open side 50 is adapted for removal of slides 10 over the user's legs after the user's feet are inserted through underwear 170 and pants 180 positioned on slides 10. Specifically, once the user's feet clear underwear 170 and pants 180 by moving them inside slides 10, slides 10 are moved up, forward and away from the user. The user then pulls underwear 170 and pants 180 up and completes dressing.

For convenience, the portable dressing aid device further comprises a handle assembly. Numeral 60 indicates fixed tubes. Fixed tubes 60 are disposed vertically on slides 10, opposite to joining block 20. Numeral 70 indicates a retractable arm. Numeral 80 indicates a handle. Retractable arms 70 are configured to extend into and out of fixed tubes 60. With retractable arms 70 extended, the user holds handles 80 while inserting feet through slides 10. Once the user's feet clear underwear 170 and pants 180, the user moves slides 10 away by handles 80.

The preferred embodiment is shown with an attachment means comprising a concave engagement surface indicated by numeral 90. Concave engagement surface 90 is disposed on joining block 20. There is also a convex engagement surface indicated by numeral 100. Convex engagement surface 100 is disposed on slide 10. The outer contour of convex engagement surface 100 fits the inner contour of concave engagement surface 90.

Also provided is a pair of guide grooves indicated by numeral 110. Guide grooves 110 are disposed vertically on edges of convex engagement surface 100.

Numeral 120 indicates a guide rail. A pair of guide rails 120 is disposed vertically on edges of concave engagement surface 90. There are a total of four guide rails 120, two guide rails 120 on each side of joining block 20 facing slide 10.

Numeral 130 indicates a bottom ridge. Bottom ridge 130 is disposed horizontally on a bottom portion of convex engagement surface 100.

Numeral 140 indicates a top ridge. Top ridge 140 is disposed horizontally on a top portion of convex engagement surface 100.

Numeral 150 indicates a spring-loaded latch. Spring-loaded latch 150 is disposed on a top portion of concave engagement surface 90.

Guide rails 120 are received in guide grooves 110, such that bottoms of guide rails 120 are abutting bottom ridge 130 and spring-loaded latch 150 engages with top ridge 140. This keeps slides 10 securely attached to joining block 20.

Numeral 160 indicates an open arch. Open arch 160 is disposed on distal end 40 opposite to open side 50. Open arches 160 are adapted for receiving the user's feet therethrough, permitting the user's feet to clear slides 10 while underwear 170 and pants 180 are placed in position on slides 10.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts.

The depicted and described preferred embodiment of the invention is exemplary only, and is not exhaustive of the scope of the invention.

Consequently, the invention is intended to be limited only by the spirit and scope of the appended claims, giving full cognizance to equivalents in all respects.

I claim:

1. A portable dressing aid device comprising a pair of elongated slides removably and symmetrically attached to a joining block by an attachment, the slides comprising:

open proximal ends adapted for inserting a user's feet and passing the user's feet through the slides;

open distal ends adapted for positioning the user's underwear and pants over the slides and inserting the user's feet therethrough;

a smooth inner surface;

a C-shaped cross section defining an open side adapted for removal of the slides over the user's legs after the user's feet are inserted through the underwear and pants;

the portable dressing aid device further comprising a handle assembly comprising:

fixed tubes disposed vertically on the slides opposite to the joining block;

retractable arms;

a handle;

wherein the retractable arms being configured to extend into and out of the fixed tubes;

wherein the attachment comprises:

a concave engagement surface disposed on the joining block and a convex engagement surface disposed on the slide, the outer contour of the convex engagement surface fitting the inner contour of the concave engagement surface;

a pair of guide grooves disposed vertically on edges of the convex engagement surface;

a pair of guide rails disposed vertically on edges of the concave engagement surface;

a bottom ridge disposed horizontally on a bottom portion of the convex engagement surface;

a top ridge disposed horizontally on a top portion of the convex engagement surface;

a spring-loaded latch disposed on a top portion of the concave engagement surface;

wherein the guide rails are received in the guide grooves such that bottoms of the guide rails abut the bottom ridge and the spring-loaded latch engages with the top ridge.

2. A portable dressing aid device as in claim 1, further comprising an open arch disposed on the distal end opposite to the open side, the open arch adapted for receiving the user's foot therethrough.

* * * * *